US006322487B1

(12) United States Patent
Dufour

(10) Patent No.: US 6,322,487 B1
(45) **Date of Patent: *Nov. 27, 2001**

(54) METHOD AND APPARATUS FOR DELIVERY OF FLAT PRINTED PRODUCTS

(75) Inventor: Charles Henry Dufour, Durham, NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/208,250

(22) Filed: Dec. 9, 1998

(51) Int. Cl.[7] ..... B31F 1/08
(52) U.S. Cl. ..... 493/424; 493/429; 271/206
(58) Field of Search ..... 493/434, 429, 493/424, 442; 271/275, 277, 204, 206

(56) References Cited

U.S. PATENT DOCUMENTS

| | | | |
|---|---|---|---|
| 3,224,306 | 12/1965 | Hawley et al. . | |
| 3,675,522 | 7/1972 | Hull . | |
| 3,999,454 | 12/1976 | Tiso et al. . | |
| 4,132,403 | 1/1979 | Weisbach et al. . | |
| 4,170,927 | 10/1979 | van der Meulen . | |
| 4,283,973 | 8/1981 | Spencer . | |
| 4,290,595 | 9/1981 | Thunker . | |
| 4,385,537 | 5/1983 | Wolf . | |
| 4,629,175 | 12/1986 | Fischer et al. . | |
| 4,765,214 | 8/1988 | Nakaya . | |
| 4,767,112 | 8/1988 | Kobler . | |
| 4,781,091 | 11/1988 | Nakaya . | |
| 4,919,027 | 4/1990 | Littleton . | |
| 5,249,493 | 10/1993 | Breton . | |
| 5,293,797 | 3/1994 | Spalding et al. . | |
| 5,417,642 * | 5/1995 | Boronka et al. | 493/429 |
| 5,452,886 | 9/1995 | Cote et al. . | |
| 5,460,479 | 10/1995 | Neumann et al. . | |
| 5,494,270 * | 2/1996 | Laubscher | 493/429 |
| 5,560,599 | 10/1996 | Curley et al. . | |
| 5,765,459 * | 6/1998 | Hillebrand | 271/277 |
| 5,846,177 * | 12/1998 | Mayr | 493/424 |
| 5,855,153 * | 1/1999 | Cote et al. | 83/23 |
| 5,921,906 * | 7/1999 | Nagano | 493/429 |

FOREIGN PATENT DOCUMENTS 1 051 110 2/1959 (DE) .

* cited by examiner

*Primary Examiner*—Eugene Kim
(74) *Attorney, Agent, or Firm*—Burns, Doane, Swecker & Mathis, LLP

(57) ABSTRACT

The present invention is generally directed to providing a method and apparatus for accurately and efficiently folding a flat product (e.g., a web of paper or signatures obtained therefrom) during its delivery. Exemplary embodiments provide a single device for performing the two functions of folding and decelerating flat products. Rotatable seizing elements of a deceleration drum interface with any known folding cylinder having a known tucker blade assembly. As such, the accurate and mark-free folding of a conventional jaw folder can be achieved with any desirable paging, including the wide maximum paging range typically associated with rotary tucker blade folders. A deceleration drum according to the present invention can interface with any folding cylinder having a tucker blade assembly used to create a cross-fold, and can thereby replace any conventional combination of a folder (e.g., rotary tucker blade folder or jaw folder) and associated downstream deceleration device. Seizing devices associated with the deceleration drum create a fold off of a fixed (e.g., a non-retractable) or a retractable tucker blade of the folding cylinder, each seizing element acting as a jaw which removes the signature, and creates the fold during product deceleration and delivery.

28 Claims, 3 Drawing Sheets

METHOD AND APPARATUS FOR DELIVERY OF FLAT PRINTED PRODUCTS

BACKGROUND OF THE INVENTION

1. Field of the Invention

The present invention relates generally to a method and apparatus for the delivery of flat products, and more particularly, to a method and apparatus for the delivery of flat products which are to be folded during delivery in a printing press.

2. State of the Art

Conventional printing presses include devices for delivering flat printed products from one stage of the press to another. For example, a web of flat material which has been sliced along its length into multiple ribbons, is typically transported to a location where the ribbons are subsequently cut along their width into signatures. The signatures are then folded one or more times to form the multiple pages of, for example, a magazine or newspaper. A typical newspaper folder may receive a collection of ribbons which have already been previously folded one or more times, and be required to implement an additional fold, such as a half fold. The number of pages which the newspaper folder is required to fold can vary widely up to, on the order of 100 broadsheet pages or more. The devices used to implement these folds include jaw folders and rotary tucker blade folders.

Jaw folders, such as jaw folders which use a jaw to interface with a fixed tucker blade, have the advantage of providing a relatively accurate, mark-free cross-fold, such as an accurate half fold. However, jaw folders are constrained in the number of pages which they can fold due to limited engagement of tucker blades and jaws used to implement the folds, as well as by the space between the tucker blade and jaw cylinders. For example, typical jaw folders are limited to folding 64 pages or less.

Rotary tucker blade folders which use a rotating cylinder having either fixed or retractable tucker blades, can accommodate a large range of paging when implementing a fold. However, rotary tucker blade folders are less accurate than jaw folders, and create more marking on the printed product.

Thus, the newspaper folders used in conventional printing presses have resulted in the accurate folding of only a limited number of pages, or have resulted in folding a larger number of pages with less accuracy. Accordingly, it would be desirable to provide a newspaper folder which can provide the accuracy and absence of marking associated with a jaw folder, without being subject to the maximum paging range typically associated with a jaw folder. Further, it would be desirable to achieve such advantages in a relatively simple configuration which can provide positive and accurate delivery of a folded product, using for example, a gripping transport device.

Although gripping transport devices are available, these devices have not been suitable for transporting folded product of, for example, a printing press used in printing newspaper. For example, U.S. Pat. No. 4,132,403, U.S. Pat. No. 4,290,595, U.S. Pat. No. 4,629,175, U.S. Pat. No. 4,767,112, U.S. Pat. No. 4,629,175, U.S. Pat. No. 5,452,886 and U.S. Pat. No. 5,560,599 disclose the use of gripping elements associated with a rotatable gripper drum for grasping a product and transporting the product to a second location. Further, these patents disclose that during transport, the product can be decelerated from a first speed to a second speed. In addition, in co-pending U.S. application Ser. No. 08/707,518, entitled "Method and Apparatus For Conveying Flat Printed Products", a conveying device for flat printed products is disclosed which includes plural arms, each having a seizing device for seizing signatures emerging from a transport device.

However, the foregoing documents do not address the inability of conventional folders to provide accurate, mark-free folding of a wide maximum paging range, or the transport of folded products from such a folder to a downstream location of a printing press.

SUMMARY OF THE INVENTION

The present invention is generally directed to providing a method and apparatus for accurately and efficiently folding a flat product (e.g., a web of paper or signatures obtained therefrom) during its delivery. Exemplary embodiments provide a single device for performing the two functions of folding and decelerating flat products. Rotatable seizing elements of a deceleration drum interface with any known folding cylinder having a known tucker blade assembly. As such, the accurate and mark-free folding of a conventional jaw folder can be achieved with any desirable paging, including the wide maximum paging range typically associated with rotary tucker blade folders. A deceleration drum according to the present invention can interface with any folding cylinder having a tucker blade assembly used to create a cross-fold, and can thereby replace any conventional combination of a folder (e.g., rotary tucker blade folder or jaw folder) and associated downstream deceleration device. Seizing devices associated with the deceleration drum create a fold off of a fixed (e.g., a non-retractable) or a retractable tucker blade of the folding cylinder, each seizing element acting as a jaw which removes the signature, and creates the fold during product deceleration and delivery.

Generally speaking, exemplary embodiments of the present invention relate to an apparatus and associated method for conveying flat products, where the apparatus comprises: a folding cylinder for use in folding a flat product; and at least one arm mounted at a first end for rotation about an axis, and having a seizing device located at a second end for establishing a fold in said flat product while seizing said flat product from said folding cylinder.

Exemplary embodiments are also directed to an apparatus and associated method for conveying flat products, wherein the apparatus comprises: a transport device for rotational transport of a flat product; and at least one arm mounted at a first end for rotation about an axis, and having a seizing device located at a second end, said seizing device being oriented relative to said transport device for seizing said flat product from said transport device in a radial direction with respect to said rotational transport of said flat product.

BRIEF DESCRIPTION OF THE DRAWINGS

The foregoing and other features of the present invention will become apparent to those skilled in the art upon reading the following description of preferred embodiments of the invention in conjunction with the accompanying drawings, wherein like elements have been designated by like reference numerals, and wherein.

DETAILED DESCRIPTION OF THE PREFERRED EMBODIMENTS

Figure 1:
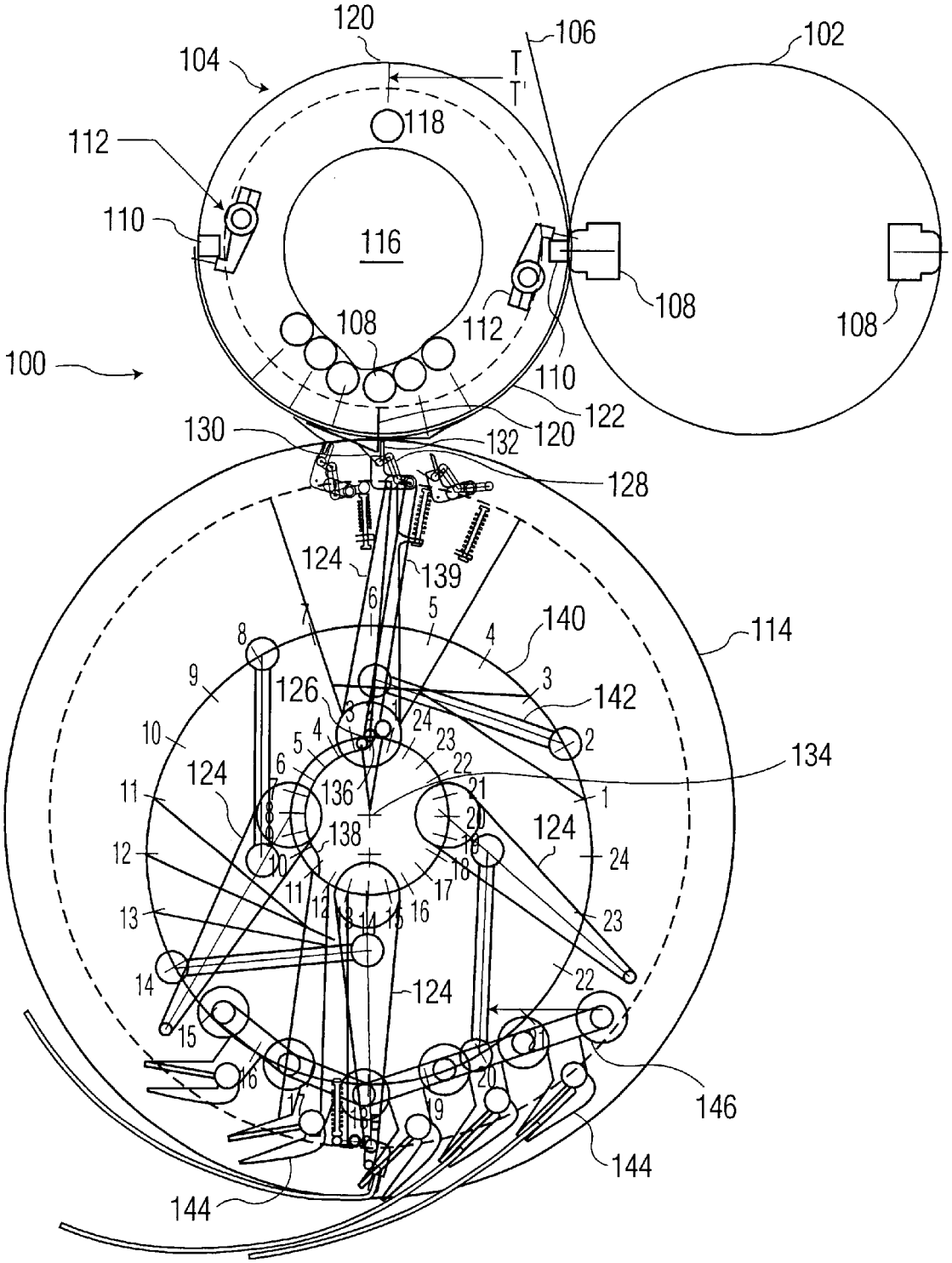
FIG. 1 shows an exemplary interface between a cutting cylinder, a folding cylinder and a deceleration drum configured in accordance with an exemplary embodiment of the present invention.

FIG. 1 shows a portion of a printing press which includes an apparatus for conveying flat products, such as the web, ribbon or signatures, processed in a rotary printing press. The FIG. 1 apparatus is illustrated as a folder portion 100 of a rotary printing press. The folder portion 100 shows how a web or ribbon used to create a printed medium, such as a magazine or newspaper, can be cut off between a cutting cylinder 102 and a folding cylinder 104.

In the FIG. 1 embodiment, the lead edge of, for example, a web 106 is established by interaction of the cutting cylinder and the folding cylinder. More particularly, the cutting cylinder 102 can be considered to include two knives 108 which rotate in a counterclockwise direction with the cutting cylinder 102. The folding cylinder 104 can be configured in any known fashion. In the FIG. 1 embodiment, the folding cylinder includes two anvils 110 which rotate in a clockwise direction with the folding cylinder 104. Movement of the cutting cylinder and the folding cylinder is synchronized in known fashion, such that a portion of the web 106 enters a nip between the cutting cylinder and the folding cylinder, where it is severed by a knife 108 which presses through the web and into a corresponding anvil 110. As a leading edge of the web 106 is established, it is impaled by pins in known fashion, using one of two cam actuated pin assemblies 112 which operate in known fashion to fix the lead edge to a surface of the folding cylinder 104.

The folding cylinder 104 can be considered a transport device for transporting a flat product, such as the web 106 or any portion thereof, from the nip between the cutting cylinder and the folding cylinder to a deceleration drum 114. The general operation of a deceleration drum is, for example, described in co-pending U.S. application Ser. No. 08/707,518, entitled "Method and Apparatus For Conveying Flat Printed Products", the disclosure of which is hereby incorporated by reference in its entirety.

The folding cylinder 104 can be configured to include any known tucker blade assembly to create a cross-fold. For example, the folding cylinder can include at least one fixed (e.g., extended, non-retractable) or retractable tucker blade, such as tucker blade 120. In the FIG. 1 embodiment, two tucker blades 120 are illustrated in conjunction with an optional, stationary cam 116 for retracting and extending the tucker blades during operation. Rollers 118 which rotate with the folding cylinder 104 move along an outer periphery of the cam 116. The rollers 118 interface with tucker blades 120. Because the FIG. 1 folder portion 100 is configured to accommodate transport of a single signature which has been severed from the web 106 to the deceleration drum 114, the folding cylinder 104 includes two pin assemblies. Thus, a succeeding lead edge severed from the web 106 can be pinned while an immediately preceding signature is removed from the folding cylinder by the deceleration drum.

Where the two tucker blades are retractable, the folding cylinder 104 can include two opposing rollers 118. To illustrate the manner by which each roller 118 and an associated tucker blade 120 interact with the deceleration drum, six successive positions of a roller 118 and associated tucker blade 120 have been illustrated in the lower half of the folding cylinder 104. As can be seen therein, when the roller 118 rotates with the folding cylinder 104 along a periphery of the cam 116, the roller 118 and associated tucker blade 120 are moved radially away from the rotational axis of the folding cylinder 104, in a direction toward a nip between the folding cylinder 104 and the deceleration drum 114. This movement of the tucker blade pushes the signature 122 radially outward from the folding cylinder so that it can be positively seized by a seizing device of the deceleration drum 114.

As shown in FIG. 1, the signature 122, after having been severed by the knife 108, is transported 180° by the folding cylinder. At this position, the cam operated tucking blade 120 drives a portion (typically the center) of the signature radially outward from the folding cylinder's surface, where it can be seized by a seizing element of the deceleration drum 114.

The deceleration drum 114 includes at least one arm 124 mounted at a first end for rotation with the deceleration drum about an axis 134. The arm itself is also rotatably mounted about an axis 126. The arm 124 has a seizing device 128 located at a second end for establishing a fold in the signature 122 while seizing the signature 122 from the folding cylinder 104. In accordance with the present invention, the seizing device 128 includes a gripper having a movably mounted gripper finger 130 and a fixedly mounted gripper bar 132, which interact with a radially outward extending tucker blade 120 of the folding cylinder 104 to grasp the signature 122 at a location at which the signature is to be folded.

In contrast to conventional gripper elements, the arm 124 and associated seizing device 128 of the exemplary FIG. 1 embodiment are configured such that the seizing device 128 is radially oriented in a first position relative to the folding cylinder 104 and thus, to a surface of the signature 122 which faces the seizing device. This first position is maintained over at least a predetermined range of rotation of the arm about an axis of rotation 134 of the deceleration drum. In the FIG. 1 embodiment, the seizing device is oriented such that the gripper bar 132 is aligned with respect to a radial axis of the folding cylinder; that is, an axis normal (i.e., perpendicular) to a surface of the folding cylinder 104 and to the surface of the signature 122. This radial orientation is maintained over an arc of rotation of the deceleration drum which is sufficient for the seizing device to properly orient itself relative to signature 122, to then seize the signature 122 at the location at which it is to be folded, and to then radially withdraw the signature from the folding cylinder 104. In the FIG. 1 embodiment, this arc is shown to be about 45°, but as those skilled in the art will appreciate, can be any angle deemed sufficient in aligning the seizing device and performing the seizing operation given the rotational velocities of the deceleration drum and the folding cylinder.

The deceleration drum 114 as shown in FIG. 1 includes four arms 124. Although not specifically illustrated, each of the four arms would, of course, include an associated seizing device 128. Each of the arms 124 is mounted at its rotational axis 126 with a pin 136 to an eccentric 140 that moves about the deceleration drum's axis 134.

The eccentric mounting will cause the arm 124 to have a velocity which varies during its rotation about the axis 134 of the deceleration drum 114. More particularly, the arms 124 will be at their maximum rotational velocity when oriented at the position where a signature 122 is grasped. The arms will then decelerate as they rotate in a counterclockwise direction from this location (i.e., as they rotate from the position at the top of the deceleration drum as oriented in FIG. 1 to a position at the bottom of the deceleration drum as oriented in FIG. 1). At their point of lowest velocity (i.e., when oriented at the bottom of FIG. 1), a grasped signature is transferred to a gripper of a downstream conveyor. A gripper-to-gripper exchange is conducted between the deceleration drum 114 and conveyor grippers 144 of the downstream conveyor 146. Thus, exemplary embodiments provide a positive control over a signature in its transfer from the folding cylinder 104 to the downstream conveyor 146.

Each of the arms 124 includes a linkage 139 which has a roller that moves along a periphery of a stationary cam 138. In addition, a linkage 142 is used to achieve interaction between the linkage 139 and the eccentric 140. The stationary cam 138 is used in conjunction with linkage 139, to either close or open the movably mounted gripper finger 130 of each seizing device. For this reason, the recess of the cam 138 transitions at the point at which the seizing device 128 is to grasp a signature, and then transitions again at a point at which the seizing device is to release the signature to the downstream conveyor. As shown in FIG. 1, the recessed portion of cam 138 extends over a range of about 120°, or more or less.

To ensure that the seizing devices are oriented with a radial axis of the folding cylinder 104 over a predetermined range of rotation of the deceleration drum, each seizing device can be articulated about an axis independently of the arm 124. Articulation of each seizing device is also controlled in response to the combined lateral and radial movement of the linkage 139 as it rotates with the deceleration drum. To illustrate this, three positions of a given seizing device 128 are illustrated at, and about, a position of the arm 124 at which the signature 122 is seized. These three illustrated positions are shown in greater detail in FIG. 2.

Figure 2:
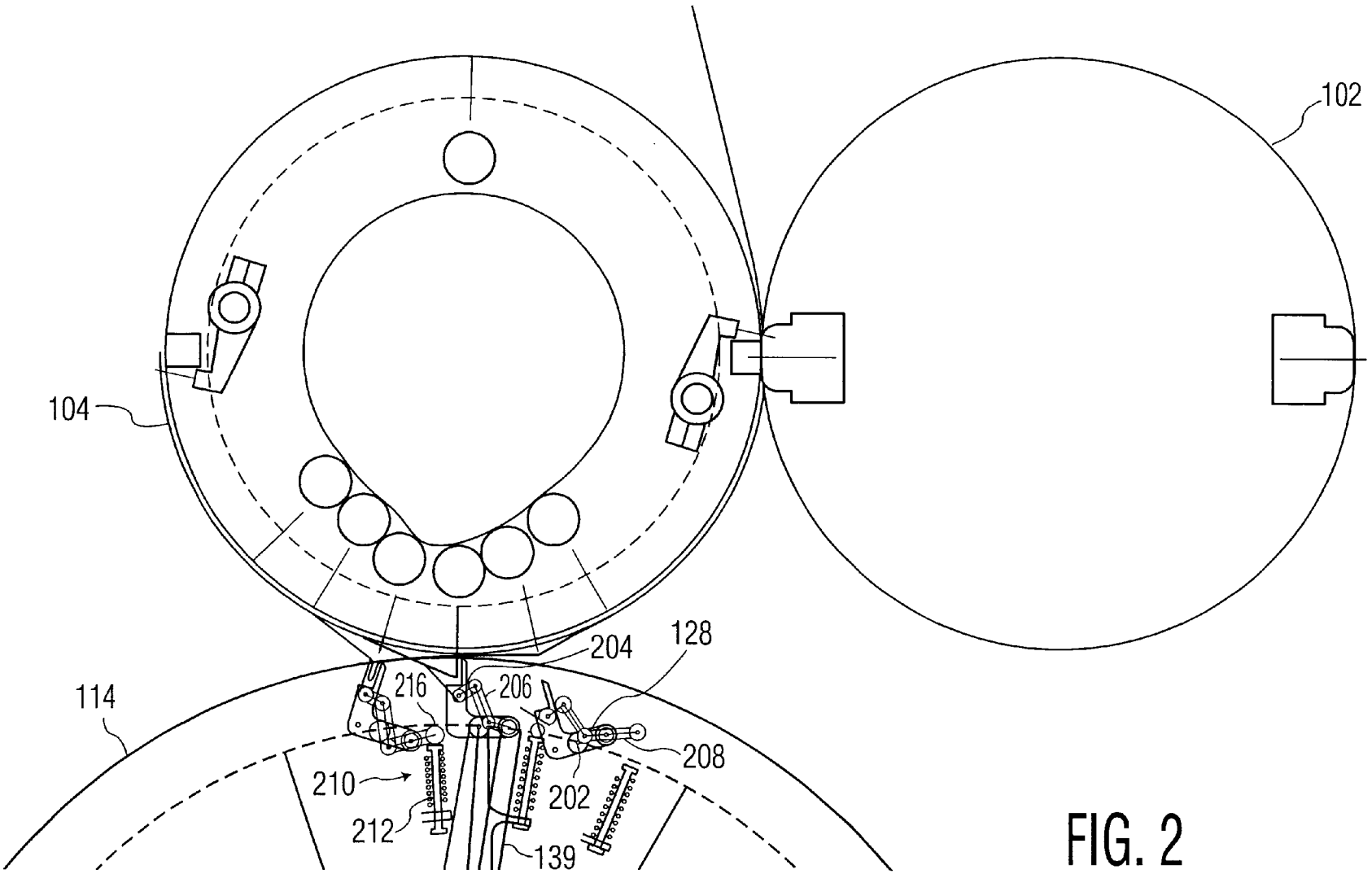
FIG. 2 illustrates details of an interface between the exemplary FIG. 1 folding cylinder and deceleration drum.

Referring to FIG. 2, the seizing device 128 is illustrated as being articulated about an axis 202. Again, articulation about the axis 202, in accordance with exemplary embodiments of the present invention, is configured such that the fixedly mounted gripper bar 132 maintains a radially aligned position with respect to a normal to a surface of the folding cylinder 104 and a surface of the signature to be folded. In accordance with exemplary embodiments, maintenance of this orientation is achieved using the linkage 139 to control rotation of the seizing device 128 about the axis 202. As shown in FIG. 2, the linkage 139 also interacts with the cam 138 to control an opening and closing of the movably mounted gripper finger 130 via additional linkages 204, 206 and 208.

As further illustrated in FIG. 2, a stop point of the movably mounted gripper finger 138 is controlled via a spring bias stop 210. The spring bias stop 210 includes a spring 212 which biases a spring rod 214 against a movable roller 216 mounted to the linkage 208. This feature permits the seizing device 128 to accommodate a wide maximum paging range without readjusting the folder portion 100. In addition, the movably mounted gripper finger 138 can itself, be spring biased to further enhance the flexibility of the seizing device in accommodating a wider maximum paging range.

Once a signature has been seized by a seizing device of the deceleration drum, the arm 124 rotates in a counterclockwise direction about the axis 134 to decelerate the signature. In accordance with exemplary embodiments, the arm and associated seizing device decelerate to a velocity which is approximately 20% of the peak velocity at the time a signature is grasped. However, those skilled in the art will appreciate that any desired variations in velocity of the deceleration drum can be implemented in accordance with a specific press operation. Increased deceleration of the arm 124 is illustrated by an increase in the angle between the arm 124 and the linkage 142. For example, note that an angle between these elements is relatively wide (e.g., on the order of 145°) when the linkage 142 is at a position designated "8" with respect to the outer circle of numbers 1–24 in FIG. 1 (the inner circle of numbers constituting positions 1–24 of the arms 124). To the contrary, the angle between the arm 124 and the linkage 142 is much smaller during an acceleration mode (such as that where the linkage 142 is at position "20" in FIG. 1).

Figure 3:
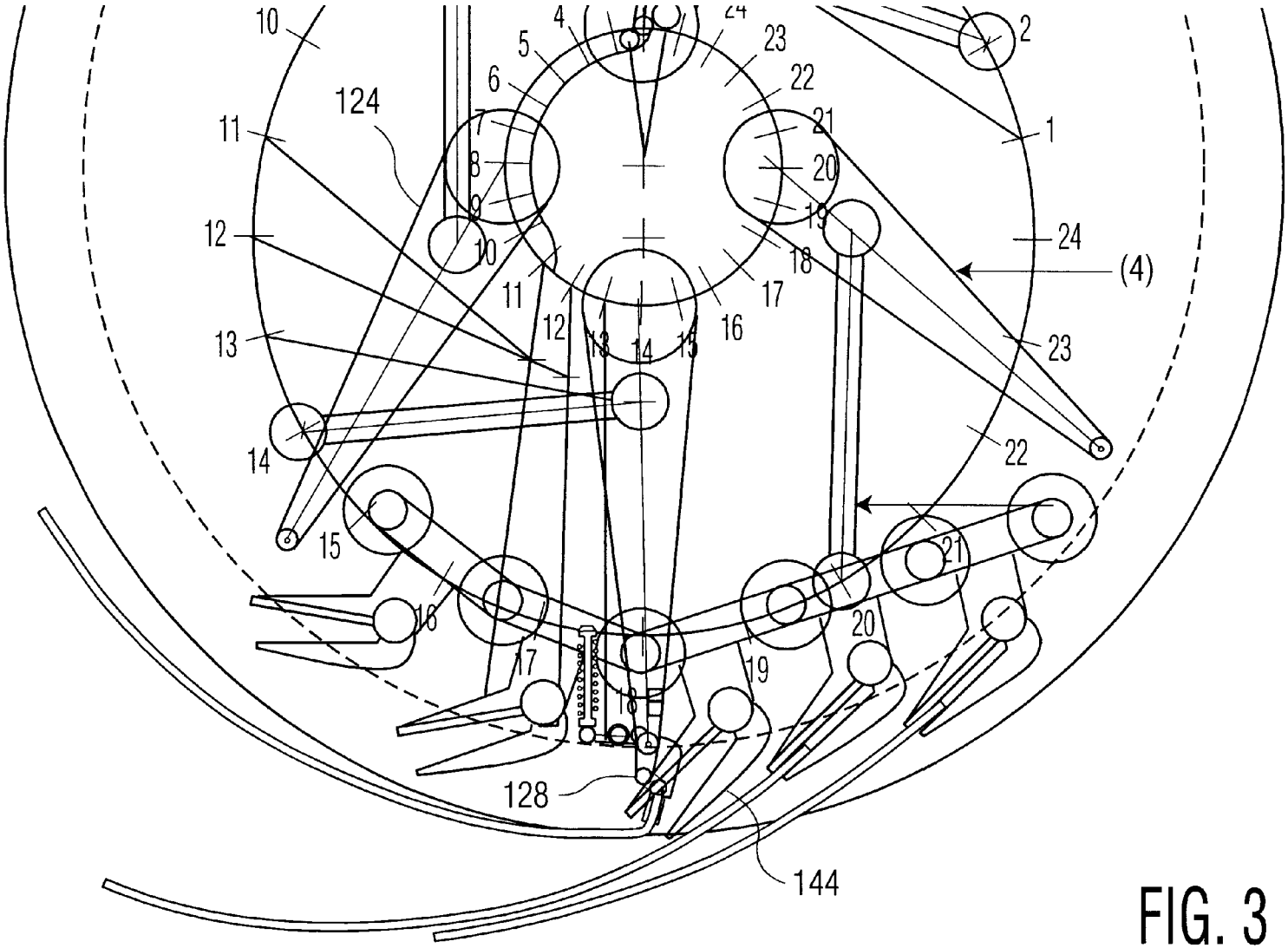
FIG. 3 shows an interface between the deceleration drum of FIG. 1 and a downstream conveyor for further transport of a flat product from the deceleration drum.

After the arm 124 has rotated to a position at which it is to release a signature, the movably mounted gripper finger 130 is opened. In the FIG. 1 illustration and as more clearly shown in FIG. 3, a seizing device 128 can be seen to move into a position adjacent a conveyor gripper 144. At this location, the movably mounted gripper finger 130 is opened via interaction of the linkage 139 and the cam 138. A corresponding cam device, which does not constitute a part of this invention and which is therefore not illustrated, can be used to concurrently cause the conveyor gripper 144 to close on the signature, and thereby positively transport it to a downstream location of the printing press.

Although exemplary embodiments of the present invention have been described in the context of the elements shown in the Figures, numerous variations will be apparent to those skilled in the art. For example, rather than using a folding cylinder with a retractable tucker blade, a cylinder configured with a fixed tucker blade can be used to interface with the seizing elements of the deceleration drum.

In addition, rather than implementing a half fold as was illustrated with respect to FIG. 1, any type of fold can be implemented in accordance with exemplary embodiments of the present invention including, but not limited to double parallel folds. Further, although exemplary embodiments have been described in conjunction with transfer of a flat product of a folding cylinder, those skilled in the art will appreciate that a deceleration drum configured in accordance with the present invention can be used in conjunction with any cylindrical transfer device of a printing press. Further, exemplary embodiments can be used in conjunction with the transport of individual signatures, or webs.

Those skilled in the art will appreciate that the FIG. 1 embodiment is shown in cross section. As such, each of the arms 124 and associated seizing devices appear in cross section. Those skilled in the art will appreciate that each such arm and associated seizing device can be configured as a plurality of aligned arms and seizing devices which extend across a width of a given signature to be grasped from the folding cylinder 104. Alternately, the arms and/or seizing devices can be configured as a single arm and/or seizing device having a width which corresponds to a width of a given signature, or any desired width. In addition, those skilled in the art will appreciate that to provide gripper-to-gripper transfer during a handoff of a signature from the deceleration drum 114 to the downstream conveyor 146, some provision for interleaving the seizing devices 128 and the conveyor grippers 144 can be provided to ensure that positive control is maintained over a signature during the entire handoff operation. For example, the seizing devices 128 can be interleaved with the conveyor grippers 144 across the width of a signature.

In accordance with exemplary embodiments, a relatively compact, positive control transfer device can be achieved.

Exemplary embodiments can provide the accuracy of a conventional jaw folder, yet provide enhanced flexibility in paging capability, and provide relatively mark-free transfer of flat products. In the exemplary embodiments illustrated herein, a single device can be used to both fold a flat product and to provide controlled slowdown of the flat product, with a controlled transfer to a downstream gripper conveyor. A gripper-to-gripper transfer eliminates the space typically associated with a pickup station required for the downstream conveyor, and minimizes misses between a belt conveyor of a conventional folder and the pickup station.

It will be appreciated by those skilled in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description and all changes which come within the meaning and range of equivalents thereof are intended to be embraced therein.

What is claimed is:

1. Apparatus for conveying flat products, comprising:

a folding cylinder for use in folding a flat product; and at least one arm mounted at a first end for rotation about an axis, and having a seizing device located at a second end, wherein: the seizing device can be oriented independently of the at least one arm, a first linkage rotatably connected to the seizing device orients said seizing device to seize said flat product from said folding cylinder in a radial direction, and at least one second linkage rotatably connected to the seizing device controls the seizing device to fold the flat product while seizing the flat product.

2. Apparatus according to claim 1, wherein said seizing device further includes:

a movably mounted gripper finger; and a fixedly mounted gripper bar.

3. Apparatus according to claim 2, wherein the linkage maintains said fixedly mounted gripper bar radially aligned with a normal to a surface of said folding cylinder over a range of rotation of said at least one arm about said axis.

4. Apparatus according to claim 3, further including:

a plurality of arms mounted at a first end for rotation about said axis, each of said plurality of arms having a seizing device.

5. Apparatus according to claim 2, wherein said movably mounted gripper finger is spring biased.

6. Apparatus according to claim 5, wherein said at least one arm further includes:

a spring biased stop mounted thereto for varying a page range of said seizing device.

7. Apparatus according to claim 1, wherein said at least one arm further includes:

a spring biased stop mounted thereto for varying a maximum page range of said seizing device.

8. Apparatus according to claim 1, wherein said folding cylinder further includes:

at least one tucker blade.

9. Apparatus according to claim 8, wherein said tucker blade is movable radially with respect to said folding cylinder, and wherein said seizing device cooperates with said tucker bar to seize said flat product from said folding cylinder.

10. Apparatus for conveying flat products, comprising:

a transport device for rotational transport of a flat product; and at least one arm mounted at a first end for rotation about an axis, and having a seizing device located at a second end, wherein: the seizing device can be oriented independently of the at least one arm, a first linkage rotatably connected to the seizing device orients said seizing device independently of the at least one arm and relative to said transport device for seizing said flat product from said transport device in a radial direction with respect to said rotational transport of said flat product, and at least one second linkage rotatably connected to the seizing device controls the seizing device to fold the flat product while seizing the flat product.

11. Apparatus according to claim 10, wherein said transport device is a folding cylinder which further includes:

at least one tucker bar.

12. Apparatus according to claim 10, wherein said seizing device further includes:

a movably mounted gripper finger; and a fixedly mounted gripper bar.

13. Apparatus according to claim 12, wherein the linkage maintainis said fixedly mounted gripper bar radially aligned with a normal to a surface of said folding cylinder over a predetermined range of rotation of said at least one arm about an axis.

14. Apparatus according to claim 13, further including:

a plurality of arms mounted at a first end for rotation about said axis, each of said plurality of arms having a seizing device.

15. Apparatus according to claim 12, wherein said movably mounted gripper finger is spring biased.

16. Apparatus according to claim 15, wherein said at least one arm further includes:

a spring biased stop mounted thereto for varying a maximum page range of said seizing device.

17. Apparatus according to claim 10, wherein said at least one arm further includes:

a spring biased stop mounted thereto for varying a maximum page range of said seizing device.

18. Apparatus according to claim 10, wherein said seizing device is radially oriented relative to the transport device over an arc of about 45°.

19. Apparatus according to claim 10, further including:

a conveyor having at least one conveyor gripper, said at least one arm transferring said flat products from said seizing device to said conveyor gripper.

20. Method for conveying a flat product, comprising the steps of:

transporting said flat product to a folding location;

rotating said flat product about an axis at said folding location; and gripping said flat product during its rotation about said axis by using an arm and a first linkage for seizing said flat product with a seizing device at a portion of said flat product in which a fold is to be established, and for radially withdrawing said flat product with the seizing device in a direction normal to said rotation of said flat product, wherein:

the seizing device can be oriented independently of the arm, the first linkage is rotatably connected to the seizing device, and at least one second linkage rotatably connected to the seizing device controls the seizing device to fold the flat product while seizing the flat product.

21. Apparatus for conveying a flat product, comprising:

a drum rotatable about a first axis;

at least one arm mounted at a first end to the drum for rotation about a second axis;

a seizing device located at a second end of the at least one arm and articulable about a third axis;

a first linkage for articulating the seizing device about the third axis for seizing the flat product in a direction normal to a surface of the flat product at a location at which the flat product is to be folded; and at least one second linkage for controlling the seizing device to fold the flat product while seizing the flat product.

22. Apparatus according to claim 21, comprising:

a folding cylinder for conveying the flat product to the drum.

23. Apparatus according to claim 21, wherein the seizing device comprises:

a fixedly mounted gripper bar; and a movably mounted gripper finger, wherein the first linkage aligns the gripper bar with a normal to a surface of the flat product at a location at which the flat product is to be folded.

24. Apparatus according to claim 23, wherein the gripper bar is aligned with a normal to a surface of the flat product at a location at which the flat product is to be folded for a predetermined range of rotation of the drum about the first axis.

25. A method for conveying a flat product, comprising:

rotating a drum about a first axis;

rotating at least one arm mounted at a first end to the drum about a second axis;

locating a seizing device at a second end of the at least one arm, wherein the seizing device is articulable about a third axis;

articulating the seizing device about the third axis with a first linkage for seizing the flat product in a direction normal to a surface of the flat product at a location at which the flat product is to be folded; and controlling the seizing device by at least one second linkage to fold the flat product while seizing the flat product.

26. Method according to claim 25, comprising:

conveying the flat product to the drum with a folding cylinder.

27. Method according to claim 25, wherein the seizing device comprises:

a fixedly mounted gripper bar; and a movably mounted gripper finger, wherein the first linkage aligns the gripper bar with a normal to a surface of the flat product at a location at which the flat product is to be folded.

28. Method according to claim 27, wherein the gripper bar is aligned with a normal to a surface of the flat product at a location at which the flat product is to be folded for a predetermined range of rotation of the drum about the first axis.

* * * * *